US007011545B2

(12) United States Patent
Brandt et al.

(10) Patent No.: US 7,011,545 B2
(45) Date of Patent: Mar. 14, 2006

(54) SOCKET CONNECTOR FOR RECEIVING A PLURALITY OF TERMINATION SOCKETS FOR COAXIAL CABLES

(75) Inventors: Konrad W. Brandt, Dusseldorf (DE); Marcus Juenemann, Ibsenweg (DE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/484,116

(22) PCT Filed: Oct. 7, 2002

(86) PCT No.: PCT/EP02/07670

§ 371 (c)(1),
(2), (4) Date: Jan. 15, 2004

(87) PCT Pub. No.: WO03/012934

PCT Pub. Date: Feb. 13, 2003

(65) Prior Publication Data

US 2004/0171300 A1 Sep. 2, 2004

(30) Foreign Application Priority Data

Jul. 21, 2001 (EP) ..... 01117814

(51) Int. Cl.
*H01R 9/05* (2006.01)

(52) U.S. Cl. ..... 439/579

(58) Field of Classification Search ..... 439/608, 439/579, 723

See application file for complete search history.

(56) References Cited

U.S. PATENT DOCUMENTS 2,970,286 A * 1/1961 Modrey ..... 439/94
4,340,265 A 7/1982 Ott et al.
4,762,508 A * 8/1988 Tengler et al. ..... 439/607
4,767,345 A 8/1988 Gutter et al.
4,820,194 A * 4/1989 Stine ..... 439/723
4,889,500 A 12/1989 Lazar et al.
4,923,412 A 5/1990 Morris
4,943,245 A 7/1990 Lincoln
5,116,230 A 5/1992 Dechelette et al.
5,184,965 A 2/1993 Myschik et al.
5,192,233 A * 3/1993 Suffredini et al. ..... 439/723

(Continued)

FOREIGN PATENT DOCUMENTS

DE 33 41 356 A1 5/1985

(Continued)

*Primary Examiner*—Briggitte R. Hammond
(74) *Attorney, Agent, or Firm*—Melanie G. Gover

(57) ABSTRACT

The socket connector for receiving a plurality of termination sockets for shielded cables each having a signal conductor and a cable shield electrically insulated relatively to the signal conductor, each termination socket having (1) a housing of electrically conductive material, at least one signal contact element within the housing and electrically insulated relatively to the housing and electrically connected to the signal conductor, and (2) at least one ground contact element within the housing and electrically insulated relatively to the signal contact element and electrically connected to the cable shield and the housing, comprises a housing (12) having adjacent receiving portions (30) for receiving the housings (34) of a plurality of shielded cable termination sockets (32), and wall sections (40) arranged between adjacent receiving portions (30), each wall section (40) comprising contact surfaces (42,44) electrically conductive and limiting the adjacent receiving portions (30) and for contacting the housings (34) of the shielded cable termination sockets (32) when inserted in the receiving portions (30), wherein said contact surfaces (42, 44) of each wall section (40) are electrically connected to each other.

18 Claims, 4 Drawing Sheets

U.S. PATENT DOCUMENTS

| | | | | |
|---|---|---|---|---|
| 5,391,096 | A * | 2/1995 | Chiron et al. | 439/724 |
| 5,775,924 | A | 7/1998 | Miskin et al. | |
| 5,829,991 | A | 11/1998 | Murphy et al. | |
| 5,831,438 | A * | 11/1998 | Okura | 324/538 |
| 5,993,254 | A | 11/1999 | Pitschi et al. | |
| 6,171,143 | B1 | 1/2001 | Charles et al. | |
| 6,203,369 | B1 | 3/2001 | Feldman | |

FOREIGN PATENT DOCUMENTS

| | | | |
|---|---|---|---|
| DE | 37 32 520 | A1 | 4/1989 |
| DE | 41 16 166 | C1 | 7/1992 |
| DE | 41 16 168 | C2 | 1/1993 |
| DE | 43 44 328 | C1 | 1/1995 |
| EP | 0 074 205 | A1 | 3/1983 |
| EP | 0 311 041 | A2 | 4/1989 |
| EP | 0 284 245 | B1 | 1/1994 |
| EP | 0 508 255 | B1 | 7/1997 |
| EP | 0 897 202 | A2 | 2/1999 |
| GB | 2 255 863 | A | 11/1992 |

* cited by examiner

SOCKET CONNECTOR FOR RECEIVING A PLURALITY OF TERMINATION SOCKETS FOR COAXIAL CABLES

This application is a 371 of PCT/EP02/07670 filed on Oct. 7, 2002.

BACKGROUND OF THE INVENTION

1. Field of the Invention

The present invention relates to improvements on socket connectors for receiving a plurality of termination sockets for coaxial cables and, in particular, for coaxial cables having a small diameter and allowing high speed and large band width signal transmission.

2. Description of the Prior Art

Basically, for connecting coaxial cables to components of electrical equipment connectors and termination sockets are used which are rotationally symmetrical with respect to their longitudinal axis. The design of these termination sockets provides a resistance behavior which is substantially identical to the behavior of the cable and, moreover, also provides a good shielding effect. Rotationally symmetrical coaxial cable termination sockets are disclosed in U.S. Pat. Nos. 4,943,245, 4,923,412, and DE 37 32 520. Due to the substantially cylindrical design of these known termination sockets, they are less suitable for miniaturization. Accordingly, a socket connector for receiving a plurality of these known termination sockets merely has a rather low density with regard to the number of coaxial cable termination sockets per volume or space needed. However, the increased requirements for electrical equipment in particular information technology equipment such as in telecommunication multiplexer lead to a high signal density of connections i.e. a high number of cable connections in a limited space.

In order to design high density socket connectors for coaxial cable termination sockets it turned out that box-shaped coaxial cable termination sockets are suitable both with regard to miniaturization of the termination socket and the side-by-side arrangement of the termination sockets in a socket connector.

U.S. Pat. No. 4,762,508 discloses a socket connector for receiving box-shaped coaxial cable termination sockets. In each of the termination sockets for the coaxial cables, the two contacts (signal and ground) are arranged side-by-side and parallel and spaced apart in a housing comprising a shield. A plurality of these termination sockets are arranged in individual compartments or receiving portions of a socket connector body of insulating material. The body is inserted into an enclosure which is built of metallic material and designed to have shielding properties.

A similar design of a socket connector for a plurality of coaxial cable termination sockets is disclosed in EP-B-0 284 245. In this reference as well as in U.S. Pat. No. 6,203,369 there is described a coaxial cable termination socket having two signal contacts for the signal conductors of two coaxial cables and one common ground contact arranged between the two signal contacts and connected with the shields of the two coaxial contacts. Moreover, box-shaped coaxial cable termination sockets also known as SCI connectors (shielded controlled impedance connectors) are described in U.S. Pat. No. 5,184,965, DE-C-41 16 168, and DE-C-41 16 166.

A certain disadvantage of coaxial cable termination sockets having a box-shaped design i.e. having a design which is non-coaxial, results in a loss of signal transmission and increase of signal reflection properties of the termination socket for high frequent signals in the range of MHz.

While the box-shaped coaxial cable termination sockets basically work fine concerning high density packaging aspects, there are limits concerning the speed and frequency of the signals transmitted through the termination sockets. With higher frequency in the range of GHz the attenuation increases.

Attempts were made in the prior art to manage the above-mentioned problem by grounding or ground bussing. One possibility to do so is to interconnect the braid or shielding layer of each coaxial cable and to connect them to a metal strap as a ground contact at the connector. This arrangement does not provide positive grounding for each cable particularly with a high number of cables.

From U.S. Pat. Nos. 5,829,991, 5,775,924, 4,340,265, and EP-B-0 508 255 electrical connector for several coaxial cables are described each having grounding means in the form of clamping and gripping elements for mechanically and, accordingly, electrically contacting the shielding layer or braid of the individual coaxial cables. However with such an arrangement it is not possible to transmit very high speed and frequency signals. Moreover, the assembly of the known socket connectors with the gripping ground means is rather time-consuming and cumbersome.

The use of a honeycomb grounding block to engage the outer conductors of several coaxial cables is disclosed in U.S. Pat. No. 4,889,500. This arrangement comprises many parts and does not meet the requirements of a cost-efficient solution for coaxial cable termination since it is expensive and complex to manufacture or assemble, respectively.

Finally, from EP-A-0 897 202, DE-C-43 44 328, and DE-A-33 41 356 it is known to contact the outer conductor of a coaxial cable by a special ground contact in the shape of a corrugated sleeve. However, the known corrugated sleeves are provided in the coaxial connectors in order to adapt the connector to coaxial cables different in diameter. In particular, the corrugated sleeves of adjacent coaxial connectors are not interconnected among each other.

Moreover, in the prior art it is known to use ground bussing strips for connecting the housings of box-like coaxial cable termination sockets. An example of such a socket connector is disclosed in U.S. Pat. No. 6,171,143 and EP-A-0 952 637. This socket connector is adapted to receive multiple coaxial cable termination sockets and includes two opposite longitudinal recesses which are adapted to expose parts of the outer conducting casings of the termination sockets. These exposed parts are contacted by a plurality of metallic fingers of two connecting elements formed like metallic strips. These connecting elements electrically connect the termination sockets with the outer casing components of the known socket connector which casing components are electrically conductive.

Moreover, from JP-A-11 074 037 another socket connector for a plurality of coaxial cable termination sockets is known having a metal housing for receiving the termination sockets. Elastic cylindrical tube-like elements wrapped by a metal layer are inserted between the termination sockets and the metal housing so as to laterally contact the row of adjacent termination sockets.

There is still the need for socket connectors for receiving a plurality of shielded cable termination sockets having ground bussing improved with regard to both electrical properties and manufacturing aspects.

SUMMARY OF THE INVENTION

The invention provides for a socket connector for receiving a plurality of termination sockets for coaxial cables each having a signal conductor and a cable shield electrically insulated relatively to the signal conductor, each termination socket having (1) a housing of electrically conductive material, at least one signal contact element within the housing and electrically insulated relatively to the housing and electrically connected to the signal conductor, and (2) at least one ground contact element within the housing and electrically insulated relatively to the signal contact element and electrically connected to the cable shield and the housing. The socket connector according to the invention comprises a housing having adjacent receiving portions for receiving the housings of a plurality of coaxial cable termination sockets, and wall sections arranged between adjacent receiving portions, each wall section comprising contact surfaces electrically conductive and limiting the adjacent receiving portions and for contacting the housings of the shielded cable termination socket when inserted in the receiving portions, wherein the contact surfaces of each wall section are electrically connected to each other.

It has been found out in electrical measurements that the path length of the ground bussing connections between the shielded cable termination sockets is rather important for the signal transmission at high speeds and frequencies. Therefore, by the invention it is suggested to design the electrical path between adjacent shielded cable termination sockets of the socket connector very short. This is achieved according to the invention by providing electrical interconnection between adjacent shielded cable termination sockets through the wall sections of the socket connector which wall sections are arranged between adjacent termination sockets for the shielded cables. These wall sections have two or more contact surfaces electrically conductive and limiting the adjacent receiving portions or compartments of the housing of the socket connector which compartments or receiving portions receive the individual termination sockets. The opposite contact surfaces of the wall sections contact the housings of the shielded cable termination sockets when inserted in the receiving portions or compartments and are electrically connected to each other. By this design the electrically paths between two adjacent termination sockets are as short as possible. This feature in turn provides for good signal transmission at increased signal speeds and frequencies up to several GHz at merely very few attenuation e.g. of 3 dB. Accordingly, the low inductive and, therefore, the low impedance connection between the termination sockets for the shielded cables ensure a large band width for the signals to be transmitted and thus a reduced reflection phenomena. Accordingly, the socket connector of the present invention provides for an increased frequency band width of signal transmission while simultaneously reducing the attenuation.

According to the invention, between receiving portions there are arranged the wall sections wherein the receiving portions can be arranged in a row or in an array with the wall sections between respective pairs of receiving portions along the row or along both directions of the array (column and row directions). Each receiving portion may include one or several termination sockets wherein the termination sockets of one receiving portion are electrically connected to the termination sockets of the adjacent receiving portion by a common wall section. In particular the housing of the socket connector according to the invention provides for receiving two rows of termination sockets wherein two termination sockets are arranged side-by-side in each receiving portion and the receiving sections are separated by individual wall sections capable of electrically contacting all the termination sockets of a receiving section.

Basically, a shielded cable comprises a signal conductor or conductor core with a sheath of insulating material surrounding the signal conductor. The insulation sheath is surrounded by a shielding layer which can be a braid or a foil of electrically conductive material. Around the shielding layer there is arranged an outer insulation jacket. A termination socket for a shielded cable comprises a signal contact element and a ground contact element which are electrically insulated and arranged in a housing wherein the housing may function as the ground contact element. In case of so-called SCI termination sockets as described in U.S. Pat. No. 5,184,965, DE-A-41 16 168, and DE-C-41 16 166 the disclosure of which are incorporated herewith by reference, the signal and ground contact elements are arranged side-by-side and electrically insulated in a box-shaped casing or housing of electrically conductive material also functioning as a shield. The SCI termination sockets are designed for miniaturized shielded cables having an outside diameter of less than 2 mm although the construction and arrangement of a SCI termination socket can also be designed to meet the dimensions of shielded cables having outer diameters different from that as mentioned before. The socket connector according to the invention in particular is suitable for coaxial cable termination sockets as described e.g. in the references mentioned above.

SCI termination sockets can be easily mounted within the receiving portions or compartments of a socket connector. Within the socket connector SCI termination sockets can be arranged at a rather high density due to their box-shaped housing or casing.

According to the invention, the wall sections having the two or more electrically conductive and electrically connected surfaces are arranged between adjacent coaxial cable termination sockets. In case of SCI termination sockets, the box-shaped housings are substantially rectangular in cross section having two parallel larger outer surfaces and two parallel smaller outer surfaces connecting the two larger surfaces. The larger outer surfaces of adjacent SCI termination sockets are facing each other with the wall sections therebetween. Accordingly, the wall sections contact the larger outer surfaces in case of the receiving portions being designed for receiving SCI termination sockets.

In one embodiment of the invention, the contact surfaces of the wall sections are provided with protrusions for contacting the housings of the coaxial cable termination sockets when inserted in the receiving portions. These protrusions may cause point-like or line-like contacts with the housings of the coaxial cable termination sockets. Line-contacts are preferred wherein the contact surfaces are wave-like shaped with the waves having any desired orientation in particular in the depth direction of the receiving portions or authogonal to the depth direction. In particular, the wall sections are provided as corrugated elements with a protrusion at the one contact surface causing the other contact surface to have a valley. In order to guaranty a good mechanical contact between the wall sections and the coaxial cable termination sockets it is preferred that the wall sections are resilient so as to generate a resilient force. This resilient force can be generated by the design or construction of the wall sections i.e. formed with corrugations or protrusions resiliently connected to the wall sections or by choosing a resilient material for the wall section or by both a design or construction feature and a material feature. If a resilient material is used such as for example rubber or the like the opposite surfaces of this material are covered by an electrically conductive material wherein these conductive material coatings are electrically connected to each other through the resilient material. As an alternative, the wall sections can comprise a core of resilient material surrounded by a housing of conductive material forming both the contact surfaces and its interconnections.

The inner cross section of each of the receiving portions corresponds to the outer cross section of the termination socket housing. In particular, in case of SCI termination sockets the receiving portions each have a rectangular cross section.

Each receiving portion is provided with an opening for inserting a termination socket and a bottom wall opposite to the opening wherein between both there are arranged side walls with two of them being formed by the contact surfaces of the wall sections. The bottom wall of each of the receiving portions is provided with bores corresponding in number and arrangement to the number and relative arrangement of the signal and ground contact elements of the coaxial cable termination sockets. The bores in the bottom walls of the receiving portions can receive connection pins extending thereto up to the ground and signal contact elements of the termination sockets. The pins may extend from for example a printed circuit board or pin strip headers or the like as basically known in the prior art for electrical connection with a socket connector.

As an alternative, the bores in the bottom walls of the housing of the socket connector according to the invention may receive spring loaded probes extending out of the housing for contacting contact pads of e.g. a printed circuit board against which the housing is forced for electrical connection between the pads of the printed circuit board and the spring loaded probes.

In order to prevent the coaxial cable termination sockets inserted in the receiving portions from undesired removal therefrom it is preferred to have at least one locking element for each receiving portion for securing the housing of a coaxial cable termination socket. The locking elements for example can be in snap fit engagement with the housings of the termination sockets and, in particular, contact those surfaces of the termination socket housings which are opposite to the bottom walls and, accordingly, are within the openings of the receiving portions.

Moreover, it is preferred to design the wall sections as individual elements separated from the socket housing. These separated elements are inserted into the housing. This design is advantageous in that the housing can be made of a dielectric plastics material which can be easily manufactured by a molding process, in particular an injection molding process, as well as other material can be used, e.g. metal in an injection molding or diecast process. while the separated wall section elements can be manufactured from a metal material in particular a metal material with resilient properties like a sheet of spring steel. Preferably, the separated wall section elements inserted into the socket housing are secured therein against an undesired removal therefrom by means of at least one locking element for each wall section element. These locking elements most preferable are in snap fit engagement with the socket housing or the wall section element. The wall section elements most preferably are inserted in receiving slots of the socket housing confronting each other so that the lateral edges of each wall section element is received by one receiving slot of a pair of receiving slots. In this design the socket housing comprises at least one receiving area formed by a recess in the socket housing and having confronting major wall portions between which the wall section elements are arranged parallel to each other so as to divide the receiving recess in a plurality of adjacent receiving portions. The embodiments of the invention having separated wall section elements inserted and guided into opposite guiding slots for receiving the opposite lateral edges of a respective wall section element are advantageous concerning easy assembly and stable construction of the socket connector with a reliable electrical connection between adjacent coaxial cable termination sockets.

In another embodiment of the invention there is provided at least one insert element for inserting into a receiving portion. This insert element is made of an electrically conductive material or comprises electrically conductive material or comprises electrically conductive opposite surfaces contacting the contact surfaces of two adjacent wall portions when the insert element is inserted into a receiving portion. The opposite conductive surfaces of the insert element are connected electrically to each other. Such an insert element can be used for electrically bridging confronting contact surfaces of adjacent wall portions of the socket housing in case that one or several receiving portions of the socket connector according to the invention is or are not provided with shielded cable termination sockets. The insert element therefore secures ground bussing of the termination sockets even if individual receiving portions due to whatever reasons are not provided with termination sockets. One of the reason may be that due to a certain electrical application the socket connector comprises less termination sockets than number of receiving portions.

In order to facilitate the insertion of the shielded cable termination sockets into the individual receiving portions of the socket connector of the invention, in one embodiment the receiving portions are provided with polarization features for engagement with polarization features of the shielded cable termination sockets. In such a design the termination sockets can only be inserted in a certain, i.e. in the correct orientation into the receiving portions.

According to the above-identified embodiments of the invention a shielded cable termination socket when inserted into a receiving portion slides along the opposing contact surfaces of two adjacent wall sections. As an alternative of this concept, according to another embodiment of the invention it is provided that the housing of a shielded cable termination socket is fixedly connected with one of the contact surfaces of a wall portion. In this embodiment, the wall portion and the shielded cable termination socket are inserted simultaneously into the housing of the socket connector. When inserted therein, that contact surface of the wall section not being connected to the shielded cable termination socket provides a surface of the neighboring receiving portion along which another shielded termination socket slides when inserted into the socket connector. Due to the fixed connection between a wall section and a shielded cable termination socket the latter can be secured against undesired removal from the socket connector in that the wall portion is locked within the socket connector.

The wall section fixedly connected to the housings of the shielded cable termination sockets according to the embodiment mentioned before can be provided with the features as mentioned above in connection with the wall sections of the other embodiments of the invention. In particular, the wall sections are provided as separate elements having protrusions and, in particular being corrugated as explained above in detail. As an alternative, the wall sections can be designed as resilient arms or tabs extending from the housing of a shielded cable termination socket and comprising an electrically conductive material for making mechanical and electrical contact with the housing of a neighboring shielded termination socket inserted into the socket connector. When several adjacent shielded cable termination sockets are inserted in the receiving area or recess of the socket connector, the spring arms or the like protruding elements of the housings of the shielded cable termination sockets divide the receiving area or recess of the socket connector into several adjacent receiving portions separated by the spring elements or the like protruding elements.

BRIEF DESCRIPTION OF THE DRAWING

The invention will be described in more detail referring to the drawing in which.

DESCRIPTION OF PREFERRED EMBODIMENTS

Figure 1:
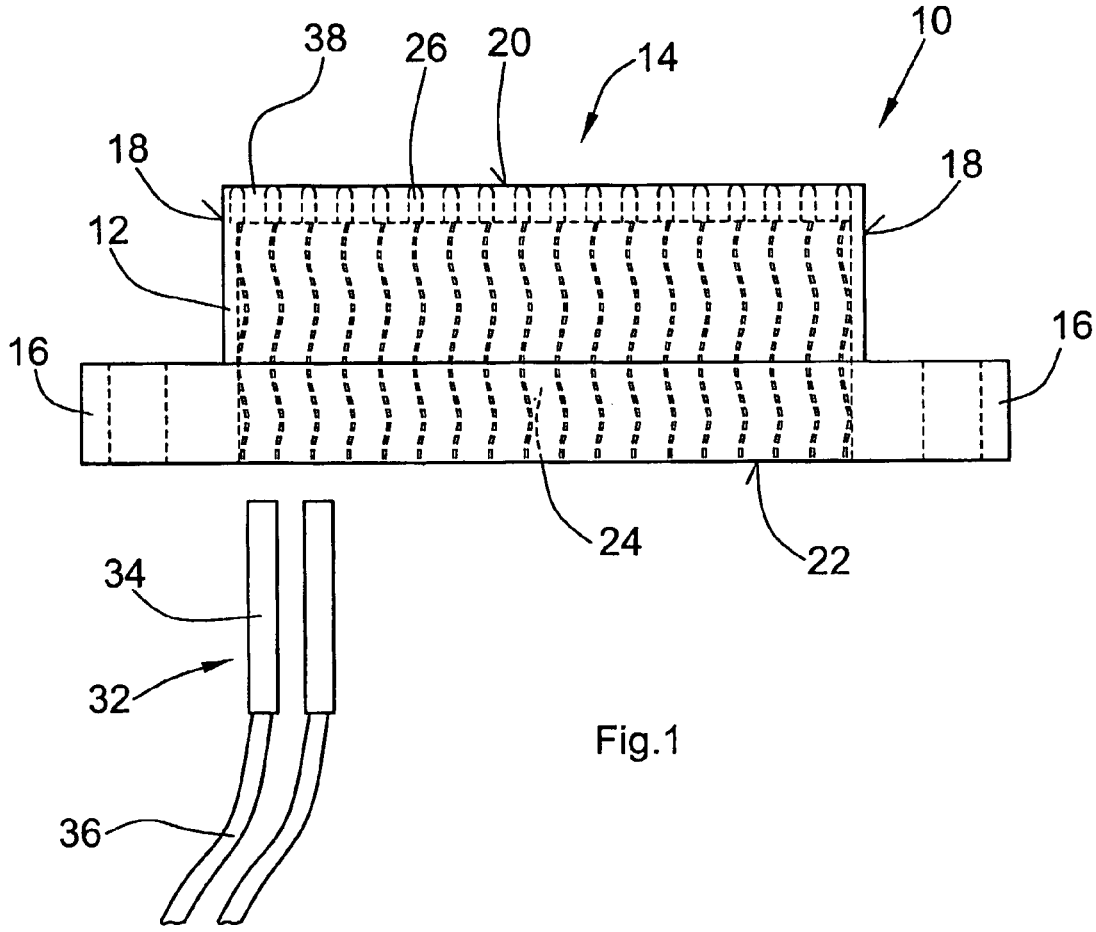
FIG. 1 is a side view of a socket connector according to a first embodiment of the invention.

In FIGS. 1 to 5 a first embodiment of a socket connector 10 is shown. The socket connector 10 comprises a housing 12 of dielectric or electrically conductive material having a major portion 14 and two flange portions 16 extending from opposite lateral sides 18 of the major portion 14. The flange portions 16 are not necessarily required. Beside the lateral sides 18 the major portion 14 of the housing 12 of the socket connector 10 is limited by a front end 20 and a rear end 22.

Figure 2:
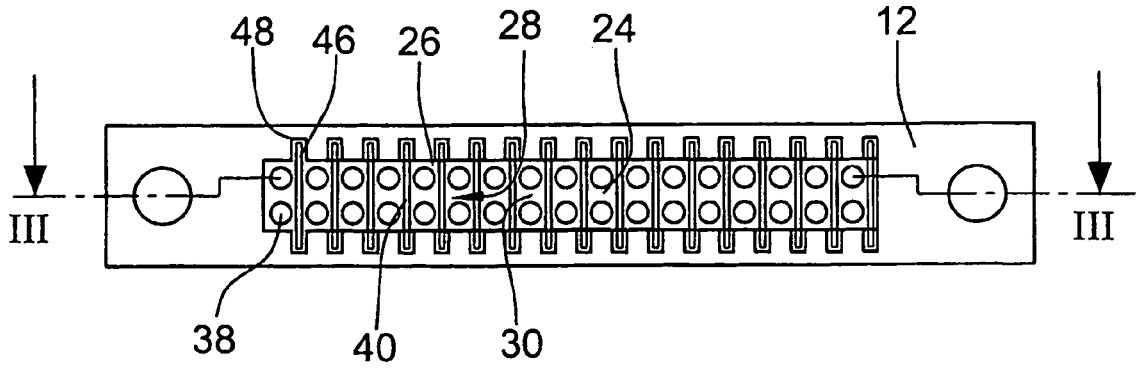
FIG. 2 is a rear view of the socket connector of FIG. 1.

As can be seen from FIG. 2 the housing 12 is provided with a recess 24 extending substantially along the complete width of the major portion 14 between the flange portions 16 and along the major portion 14 towards the front end 20. The recess 24 is open at the rear end 22 and is limited by a bottom wall portion 26 of the housing 12. As also depicted in FIG. 2, the recess 24 is divided by individual wall sections 28 into compartments or receiving portions arranged in a row and separated by the wall sections 28.

The socket connector 10 is designed for receiving a plurality of box-shaped coaxial cable termination sockets as referred to in the prior art as SCI-termination sockets. Examples for these SCI-termination sockets are described in U.S. Pat. No. 5,184,965, DE-A-41 16 168, and DE-C-41 16 166. The construction of an SCI termination socket 32 is generally known to persons skilled in the art and comprises a housing 34 having a ground contact element and a signal contact element to be connected with the shielding and the conductor of a coaxial cable 36. The two contact elements are insulated relatively to each other and are arranged within a core of dielectric material surrounded by the housing 34 of electrically conductive material wherein the housing 34 is electrically connected to the ground contact element of the SCI-termination socket 32. Accordingly, by way of an SCI termination socket the two conductive elements of a coaxial cable 36, i.e. the signal conductor and the shielding are transferred to contact elements arranged side by side and enclosed by a box-shaped housing 34.

When inserted into the socket connector 10, the individual SCI-termination sockets 32 are received by the receiving portions 30 with the contact elements of the SCI-termination sockets 32 being closed to the bottom wall 26. The bottom wall 26 per each receiving portion 30 comprises two bores 38 extending through the bottom wall 26 from the recess 24 to the front end 20 of the major portion 14 of the socket connector 10. In the embodiment according to FIGS. 1 to 5 termination pins of the counterpart of the socket connector 10 extend through the bores 38 and into the recess 24 so as to make contact with the contact elements of SCI-termination sockets 32 inserted in the receiving portions 30.

The individual wall sections 28 are provided as separate wall section elements 40 of an electrically conductive material. As can be seen from FIGS. 4 and 5, each wall section element 40 is corrugated and, accordingly, comprises protrusions 41. The wall section elements 40 are made of a metal and, in particular, of spring steel so as to be resilient. Each wall section element 40 has two opposite contact surfaces 42,44 for mechanically and electrically contacting with the housings 34 of two SCI-termination sockets 32 between which the wall section element 40 is arranged. The sheet-like corrugated element 40 serves for grounding the SCI termination sockets 32 so as to provide a ground bussing. Due to the plurality of contact areas between the wall section elements and the adjacent SCI-termination sockets a current path having a rather low impedance and resistance is provided which results in an improved ground bussing. This in turn makes it possible to transfer signals with a frequency of more than several GHz while simultaneously maintaining a rather low attenuation.

Figure 3:
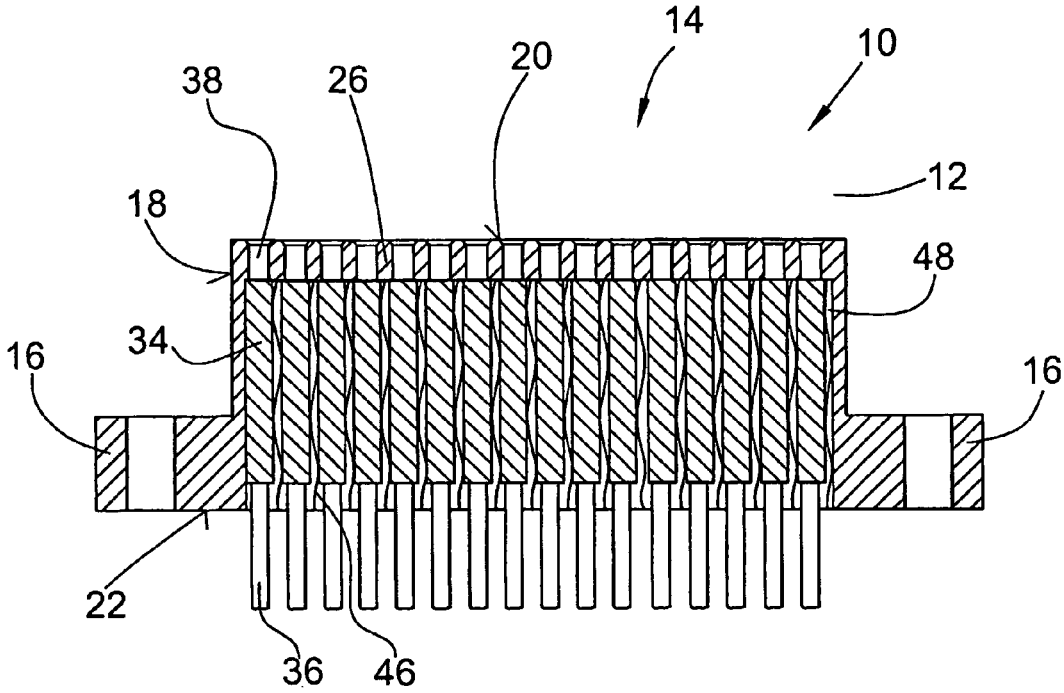
FIG. 3 is a cross sectional view of the socket connector of FIG. 1 taken along line III—III of FIG. 2.
Figure 4:
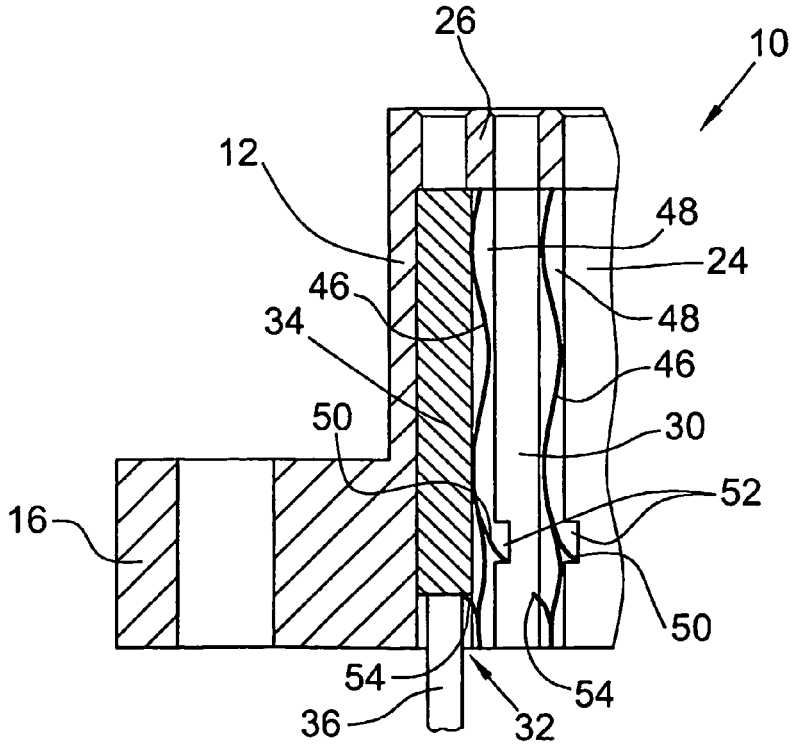
FIG. 4 is a detailed partial view on a larger scale of the cross sectional view of FIG. 3.
Figure 5:
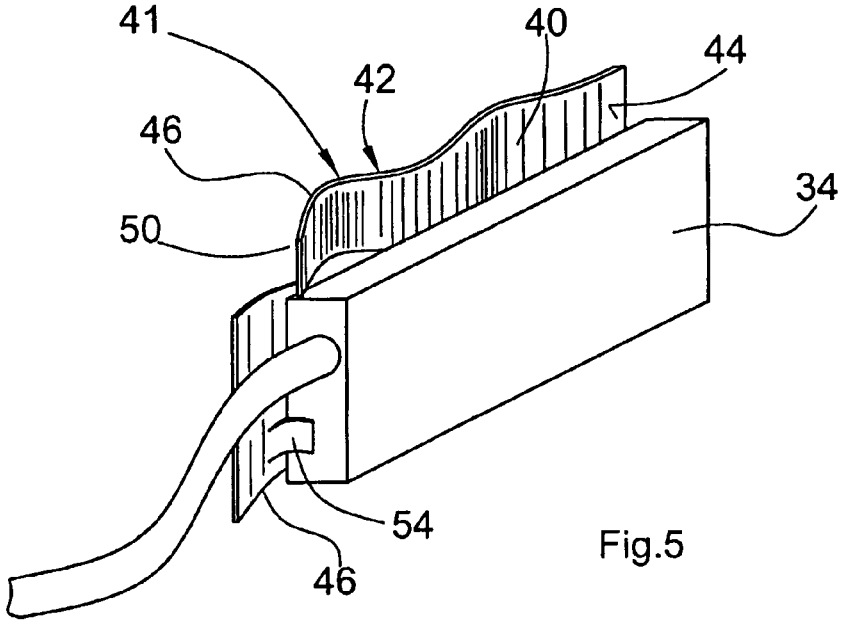
FIG. 5 is a perspective view showing the interengagement of a wall section element and a SCI-termination socket without the surrounding parts of the socket connector.

As can be seen from FIGS. 3 and 4, the lateral edges 46 of each wall section element 40 are inserted into slots 48 formed in the housing 12 and being open toward the recess 24. When assembling the socket connector 10, the wall section elements 40 are inserted into the slots 48 of the housing 12. In order to retain the wall section elements 40 within the housing 12 of the socket connector 10, each element 40 at one of its lateral edges 46 is provided with a locking arm 50 protruding from one of the contact surfaces 42,44. The locking element or locking arm 50 integrally formed with the element 40 snaps into a corresponding notch 52 in one of the two slots 48 receiving the element 40. This situation can be seen in FIG. 4.

Moreover, in order to retain an SCI-termination socket 32 in a receiving portion 30, a protruding locking element 54 is provided at each of the wall section elements 40 for gripping the end of the housing 34 of the SCI-termination socket 32 being opposite to the bottom wall 26 of the housing 12 of the socket connector 10. This locking element 0.54 is resilient and can be bent by some means out of the passage through which the SCI-termination socket 32 is inserted into a receiving portion 30. Accordingly, an SCI-termination socket 32 already inserted into the socket connector 10 can be still replaced and removed.

Figure 9:
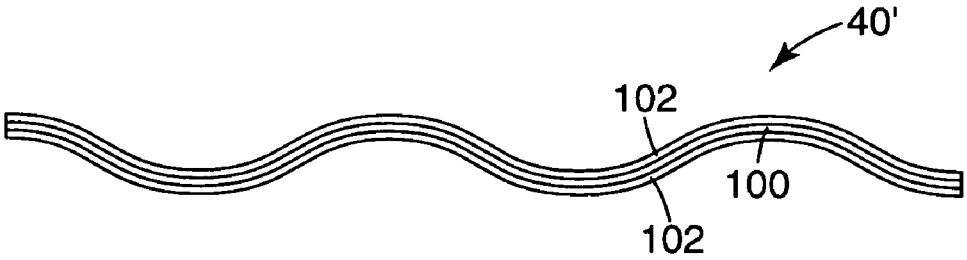
FIG. 9 is a side view of a wall section element comprising a core of dielectric material coated by an electrically conductive material.

As already stated above, the wall section elements 40 provide electrical interconnection between adjacent SCI-termination sockets 32. The material of the elements 40 can be copper, e.g. with beryllium. However, also other metallic or nonmetallic electrically conductive materials are suitable. Finally, as illustrated in FIG. 9, it is also possible that each wall section element 40' comprises a core of dielectric material 100 coated by an electrically conducting material 102. Such an element would also work as an electrical interconnection due to the skin effect of high frequency signals transmitted through the SCI termination sockets. A superior coating material is for example gold, while the core can be corrugated iron or corrugated steel having resilient features.

Figure 6:
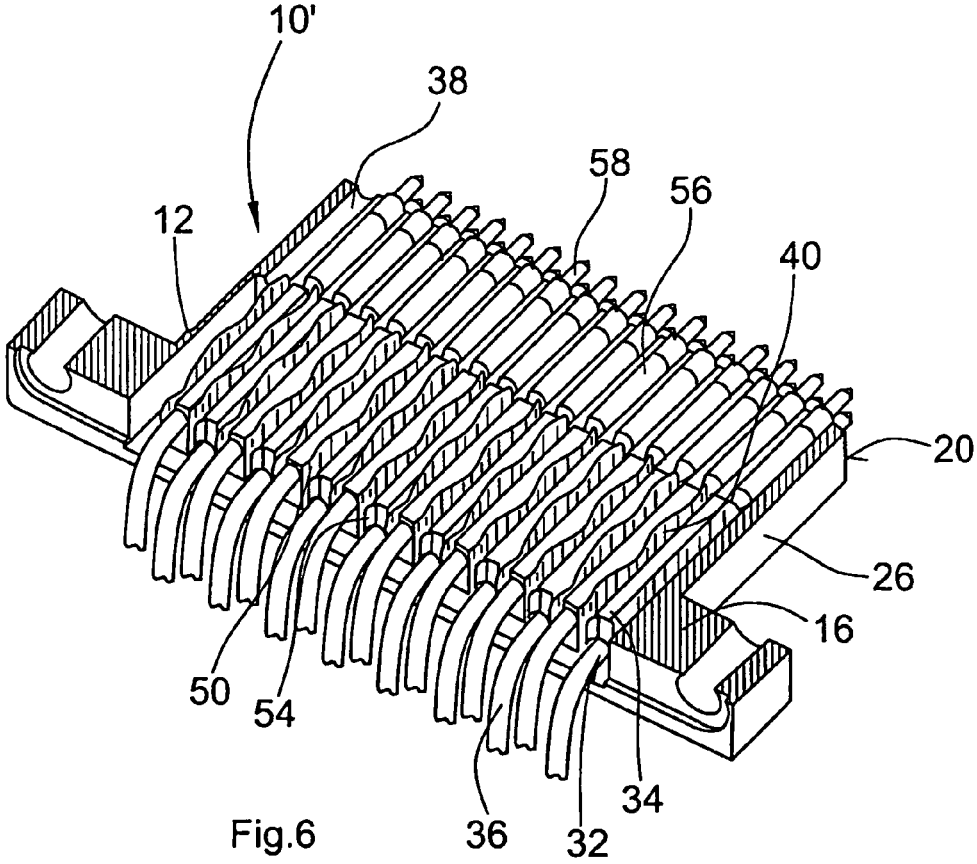
FIG. 6 is a cross sectional view of a socket connector according to an alternative embodiment.

In FIG. 6 another embodiment of a socket connector 10' according to the invention is shown. In this Fig. elements which from their construction or function are similar or identical to the elements of the embodiment of FIGS. 1 to 5 are marked with the same reference numerals.

The only difference between the socket connectors 10 and 10' is that within the bores 38 spring loaded probes 56 are inserted. Each probe 56 is provided with a spring bias first end having the shape of a tip 58 and extending beyond the front end 20 of the socket connector housing 12. The other end of each probe 56 extends into the recess 24 so as to engage with one of the contact elements of the SCI-termination sockets 32. The use of spring loaded probes 56 in socket connectors is basically known. Electric contact is achieved by pressing the socket connector 10' with the spring loaded tip ends against contact pads of i.e. a printed circuit board.

All the other features described in connection with the socket connector 10 according to FIGS. 1 to 5 are also given in the socket connector 10' according to FIG. 6. In particular the socket connector 10 is also provided with an improved ground bussing due to the very short electrical interconnections between the housings of adjacent SCI-termination sockets 32 resulting in a low impedance and resistance of the current path.

Figure 7:
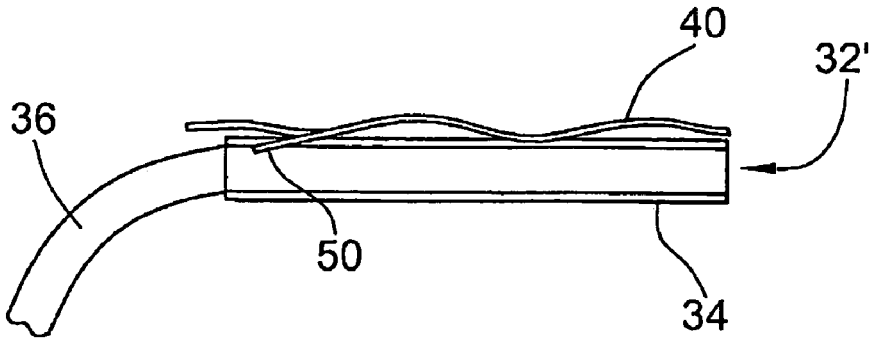
FIG. 7 is a side view of an alternative SCI-termination socket to which a wall section element is fixedly connected.
Figure 8:
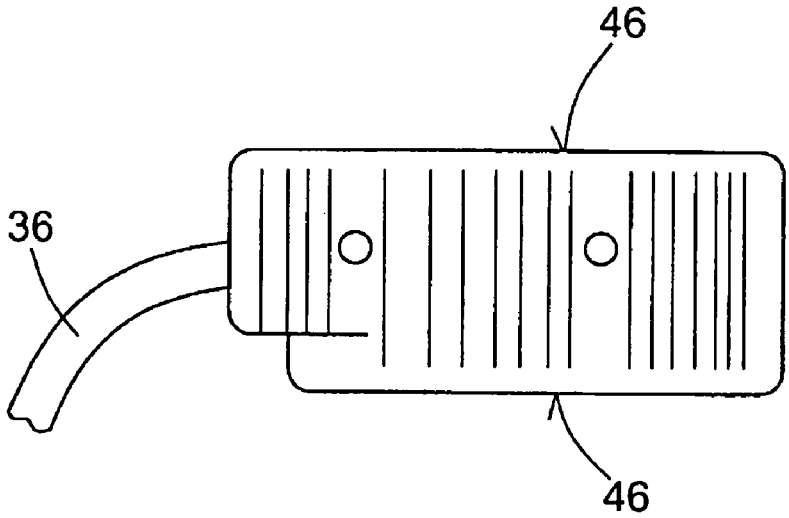
FIG. 8 is another side view of the SCI-termination socket of FIG. 7.

An alternative embodiment for an SCI-termination socket 32' is shown in FIGS. 7 and 8. Again in this embodiment the same reference numerals are used as in the other embodiments as long as the parts and features are the same.

In the design of the SCI-termination socket 32' of FIGS. 7 and 8, the housing 34 is fixedly connected to a wall section element 40 by adhesive bonding, welding, soldering or the like. The construction and features of the element 40 of FIGS. 7 and 8 are the same as in case of the embodiments described before. The only difference is that a locking element for locking the housing 34 of the SCI termination socket 32 at the element 40 is no longer necessary due to the solidly bonding of both parts. However, the wall section element 40 of the embodiment of FIGS. 7 and 8 also is provided with the locking element 50 engaging with the socket connector housing 12 in that the locking element 50 snaps into the notch 52 of that slot 48 receiving the respective lateral edge 46 of the element 40.

What is important in the embodiment of FIGS. 7 and 8 is that the wall section element 40 fixedly connected to the housing 34 of the SCI-termination socket 32' and providing contact to the housing 34 of an adjacent SCI-termination socket 32' builds the separating element between adjacent receiving portions of the socket connector when the SCI-termination sockets 32' are inserted into the socket connector. Accordingly, the wall section elements 40 with its lateral edges 46 extend beyond the housing 34 of the SCI-termination socket 32' so as to be guided in and received by the slots 48 of the socket connector as shown for the other embodiments in FIGS. 3, 4, and 6.

The present invention is described above in connection with an embodiment in which each receiving portion 30 is provided for receiving one termination socket 32. However, it is clear to the artisan that each receiving portion 30 can be designed to receive several termination sockets 32 each contacting at least one common wall section 40. For example two termination sockets 32 can be arranged with their small sides confronting and contacting each other wherein each of the wall sections 40 separating adjacent receiving portions 30 contacts both and (in more general terms) all of the termination sockets 32 of the respective receiving portion.

As will be apparent to those skilled in the art, in the light of the foregoing disclosure many alternations and modifications are possible in the practice of this invention without departing from the spirit or scope thereof. Accordingly, the scope of invention is to be construed in accordance with the substance defined by the following claims.

The invention claimed is:

1. Socket connector for receiving a plurality of termination sockets for shielded cables each having a signal conductor and a cable shield electrically insulated relative to the signal conductor, each termination socket having a housing of electrically conductive material, at least one signal contact element within the housing and electrically insulated relative to the housing and electrically connected to the signal conductor, and at least one ground contact element within the housing and electrically insulated relative to the signal contract element and electrically connected to the cable shield and the housing, said socket connector comprising a housing having adjacent receiving portions for receiving housings of a plurality of shielded cable termination sockets and having a plurality of opposing slots between adjacent receiving portions, and wall sections having lateral edges extending beyond the housing of the shielded cable termination socket for insertion into and guidance by said opposing slots in said socket housing, each wall section comprising contact surfaces electrically conductive and limiting the adjacent receiving portions and for contacting the housings of the shielded cable termination sockets when inserted in the receiving portions, wherein said contact surfaces of each wall section are electrically connected to each other.

2. Socket connector of claim 1, wherein the receiving portions are substantially rectangular in cross section for receiving box-shaped shielded cable termination sockets.

3. Socket connector of claim 1, wherein each of said receiving portions is provided with at least one locking element for securing the housing of a shielded cable termination socket in said receiving portion against undesired removal therefrom.

4. Socket connector of claim 1, further comprising at least one insert element for inserting into a receiving portion, said insert element made of an electrically conductive material or comprising an electrically conductive surface, said insert element for electrically bridging the confronting contact surfaces of adjacent wall portions of said socket housing.

5. Socket connector of claim 1, wherein said contact surfaces of each of said wall section are provided with protrusions for contacting the housings of the shielded cable termination socket when inserted in said receiving portions.

6. Socket connector of claim 5, wherein said protrusions are formed by corrugations extending across said contact surfaces of said wall sections.

7. Socket connector of claim 5, wherein said protrusions are resilient.

8. Socket connector of claim 1, wherein said wall sections are resilient for generating a resilient force for contacting, by said contact surfaces of said wall sections, the housings of the shielded cable termination sockets when inserted in said receiving portions.

9. Socket connector of claim 8, wherein said wall sections comprise a resilient material.

10. Socket connector of claim 9, wherein the resilient material is covered by an electrically conductive material on at least two outer sides forming said contact surfaces of a respective wall section.

11. Socket connector of claim 9, wherein the resilient material is electrically conductive for electrically connecting the contact surfaces of a respective wail section.

12. Socket connector of claim 9, wherein the resilient material is covered by an electrically conductive material for forming said contact surfaces of a respective wall section and the electrical connection of said contact surfaces.

13. Socket connector of claim 1, further characterized by a bottom wall of said socket housing limiting the receiving portions and arranged opposite to openings for access to the receiving portions, said bottom wall comprising bores extending from each of the receiving portions to an outside surface of said socket housing said bores for receiving termination pins for engaging the contact elements of the shielded cable termination sockets when inserted into said receiving portions.

14. Socket connector of claim 13, further comprising spring loaded probes inserted into said bores each spring loaded probe having a first end resiliently arranged and extending at least partially outside said outer surface of said socket housing and a second end for engaging a contact element of a shielded cable termination socket when inserted into a receiving portion.

15. Socket connector of claim 1, wherein said wall sections are separated elements inserted into said socket housing so as to separate adjacent receiving portions and wherein each wall section element is provided with a locking element for securing said wall section element against undesired removal from said socket housing.

16. Socket connector of claim 15, wherein said wall section elements at lateral edges thereof are inserted in receiving slots of said socket housing.

17. Socket connector of claim 1, wherein a housing of a shielded cable termination socket is bonded to one of the contact surfaces of a respective wall portion.

18. Socket connector of claim 17, wherein the housing of a shielded cable termination socket is bonded to the contact surface of a respective wall portion by an adhesive, welding or soldering.

* * * * *

UNITED STATES PATENT AND TRADEMARK OFFICE

CERTIFICATE OF CORRECTION

PATENT NO. : 7,011,545 B2
APPLICATION NO. : 10/484116
DATED : March 14, 2006
INVENTOR(S) : Brandt, Konrad W.

It is certified that error appears in the above-identified patent and that said Letters Patent is hereby corrected as shown below:

Column 1,
Line 47, delete “are” and insert -- is --.

Column 3,
Line 11, after “comprises” insert -- : --.

Column 4,
Line 55, delete “authogonal” and insert -- orthogonal --.

Column 5,
Line 52, after “process” delete “while” and insert -- While --.

Column 6,
Line 28, delete “reason” and insert -- reasons --.

Column 7,
Line 13, after “which” insert -- : --.

Column 10,
Line 30, after “comprising” insert -- : --.

Column 11,
Line 14, delete “wail” and insert -- wall --.

Signed and Sealed this

Twentieth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 7,011,545 B2
APPLICATION NO. : 10/484116
DATED : March 14, 2006
INVENTOR(S) : Konrad W. Brandt It is certified that error appears in the above-identified patent and that said Letters Patent is hereby corrected as shown below:

Page 1, (PCT) filed, delete Oct. 7, 2002 and insert July 10, 2002

Signed and Sealed this

Seventeenth Day of October, 2006

JON W. DUDAS
*Director of the United States Patent and Trademark Office*